343-872 SR
1/6/87 XR 4,635,067

United States Patent [19]

Fitzpatrick

[11] Patent Number: 4,635,067

[45] Date of Patent: Jan. 6, 1987

[54] AERODYNAMIC RADAR POD WITH EXTERNAL INFLATABLE PORTION

[75] Inventor: Roger S. Fitzpatrick, Somerset, England

[73] Assignee: GEC Avionics Limited, England

[21] Appl. No.: 657,774

[22] Filed: Oct. 4, 1984

[30] Foreign Application Priority Data

Oct. 10, 1983 [GB] United Kingdom ..... 8327075

[51] Int. Cl.[4] ..... H01Q 1/28; H01Q 1/42

[52] U.S. Cl. ..... 343/705; 343/872; 244/130; 244/137 A

[58] Field of Search ..... 343/705, 706, 708, 872, 343/880, 882; 244/118.1, 118.2, 130, 137 A

[56] References Cited

U.S. PATENT DOCUMENTS

| | | | |
|---|---|---|---|
| 2,702,346 | 2/1955 | Evans et al. | 343/872 |
| 3,176,302 | 3/1965 | Tipton | 343/872 |
| 3,656,164 | 4/1972 | Rempt | 343/705 |
| 4,030,779 | 6/1977 | Johnson | 244/130 |

FOREIGN PATENT DOCUMENTS

| | | | |
|---|---|---|---|
| 1492173 | 11/1977 | United Kingdom | 343/705 |

OTHER PUBLICATIONS

Skolnik, "Radar Handbook", McGraw Hill, 1970, FIGS. 27 and 28.

Flight International, IPC Press, United Kingdom, Mar. 6, 1975, p. 364.

"Airborne Kite Balloons", Airborne Industries, United Kingdom, 1980, p. 7.

Airborne Early Warning, Osprey Publishing, United Kingdom, 1980, p. 165.

World Electronic Warfare Aircraft, Janes Publishing, United Kingdom, 1983, pp. 84–85.

*Primary Examiner*—Eli Lieberman
*Assistant Examiner*—Michael C. Wimer
*Attorney, Agent, or Firm*—Kirschstein, Kirschstein, Ottinger & Israel

[57] ABSTRACT

A retractable airborne radar pod housing a radar scanner is provided with inflatable portions which when deflated allow the pod to be retracted into the aircraft and when inflated form an aerodynamic shape.

8 Claims, 9 Drawing Figures

AERODYNAMIC RADAR POD WITH EXTERNAL INFLATABLE PORTION

BACKGROUND OF THE INVENTION

The present invention relates to airborne scanning radar systems.

Aperturres in aircraft fuselages (such as the rear loading doors of cargo aircraft) are typically longer in the fore-and-aft sense than they are wide. A body such as a radar pod which can be extended from such an aperture and/or retracted into it may similarly be longer than it is wide.

It is sometimes desirable in radar engineering to provide a radar aerial with the maximum attainable horizontal dimension (known as aperture). It is then sometimes desirable to rotate such an aerial in azimuth when in operation.

Whereas it is hence possible to deploy from the fuselage of an aircraft in flight a radar aerial with an aperture which is larger than the fuselage is wide, by the expedient of aligning it fore-and-aft during this process, it is undesirable to then rotate it through large angles if doing this would create an aerodynamically asymmetric body with reference to the aircraft's direction of flight and so generate unusual aerodynamic forces.

SUMMARY OF THE INVENTION

According to the present invention an airborne radar scanner arrangement comprises:

(a) an aerodynamic radar pod (b) a radar scanner mounted for rotation within said pod (c) an aircraft fuselage, and (d) means being provided for deploying said pod from and retracting said pod into said aircraft fuselage wherein said pod incorporates at least one exterior inflatable portion, means being provided for internally pressurising said portion when the pod is deployed to inflate said portion and thereby define part of the aerodynamic shape of the pod and means being provided for depressurising said portion on retraction of said pod into the aircraft fuselage.

The pod may incorporate one or more inflatable fairings supported on its outer wall or it may incorporate one or more flexible membranes stretched over respective apertures in its wall, and arranged to bulge out when the pod is pressurised.

The pod may be arranged to rotate with the scanner (i.e. it may be a rotodome) or it may be non-rotating, in which case it may be elongate and incorporate two flexible membranes on oppositely located transverse apertures in its outer wall, such that when the pod is pressurised the membranes bulge out and accommodate the rotation of the scanner and when the pod is depressurised the scanner is accommodated longitudinally within the pod.

The aircraft may be a helicopter or a fixed-wing aircraft. The pod may be supported on a unit arranged to be bodily loaded into an aircraft fuselage via a cargo-loading aperture.

According to another aspect of the invention an airborne radar system comprises a rotatable radar scanner mounted in an aircraft fuselage and arranged to be deployed from the fuselage in flight of the aircraft, wherein the scanner is housed in a pod which is at least partially inflatable so as to form an aerodynamic shape when deployed, and wherein the diameter of the volume swept out by the rotating scanner is greater than the largest interior transverse dimension of the fuselage parallel to the plane of rotation.

The pod may be a rotodome.

The pod may be mounted on a pylon and arranged to be deployed from a caro-loading aperture of the aircraft. The aircraft may be a helicopter.

Attention is drawn to our U.K. patent specification No. 2127369, which is hereby incorporated by reference.

Two embodiments of the invention will now be described by way of example with reference to FIGS. 1 to 6 of the accompanying drawings, of which:

FIG. 1 is a transverse sectional elevation of a retractable rotodome in accordance with the invention mounted in a Shorts 3M skyvan, FIG. 2 is a sectional elevation showing in more detail the deployment mechanism of FIG. 1, FIG. 3 is a rear elevation, partially in section, of the arrangement of FIG. 1, FIG. 4 is a plan view, partially in section, of the rotodome of FIGS. 1 to 3, FIG. 5 is a plan view, partially cut away, of the arrangement of FIGS. 1 to 3, showing the stowed rotodome, FIG. 6*a* shows a non-rotating partially inflatable aerodynamic pod in accordance with the invention, FIG. 6*b* is a sectional end elevation of the pod of FIG. 6*a* deployed but not inflated, FIG. 6*c* is a sectional end elevation of the pod of FIG. 6*a* deployed and inflated, and FIG. 6*d* is a side elevation in section of the pod of FIG. 6*a* deployed.

DETAILED DESCRIPTION OF THE PREFERRED EMBODIMENTS

Figure 1:
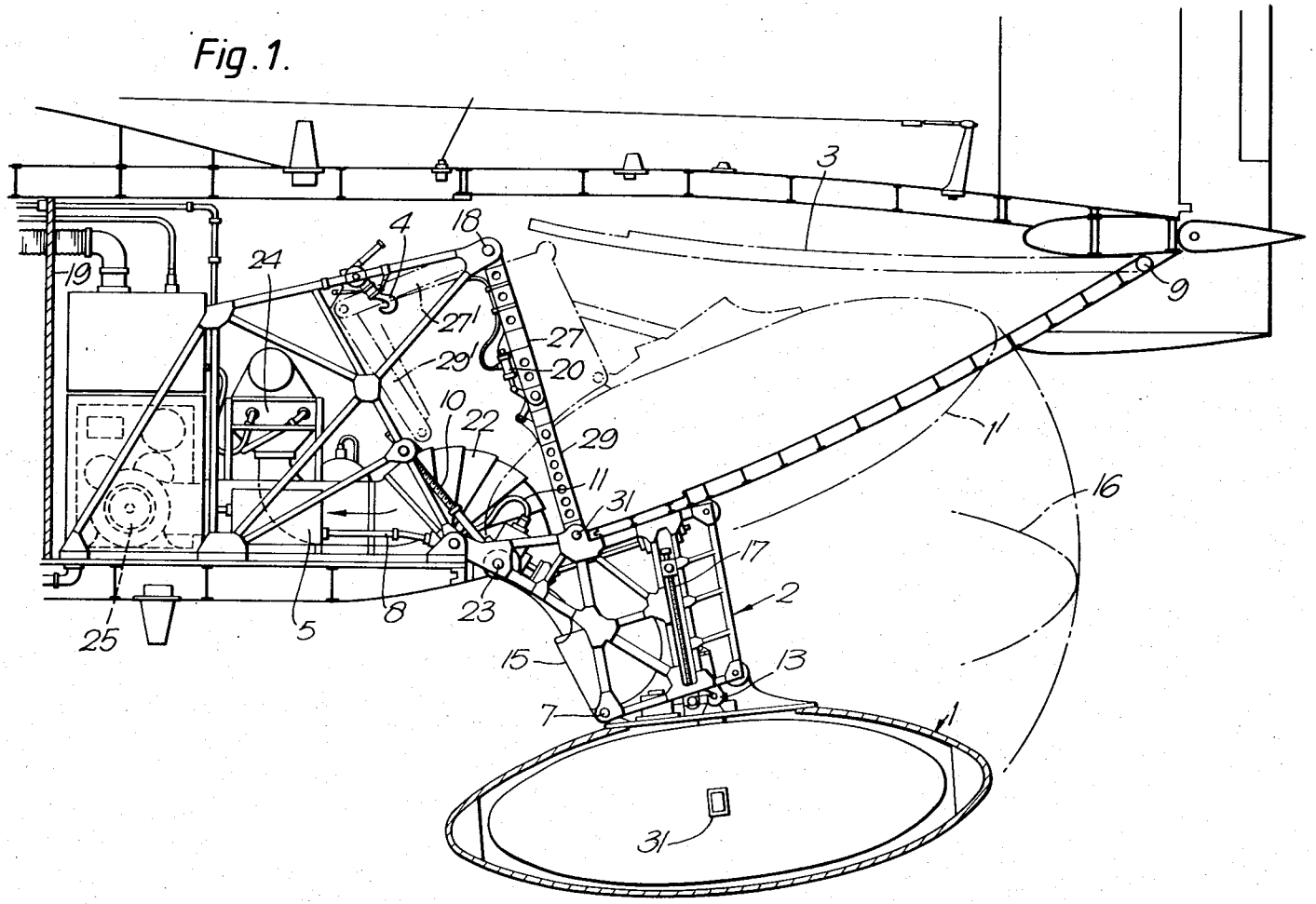
Figure 2:
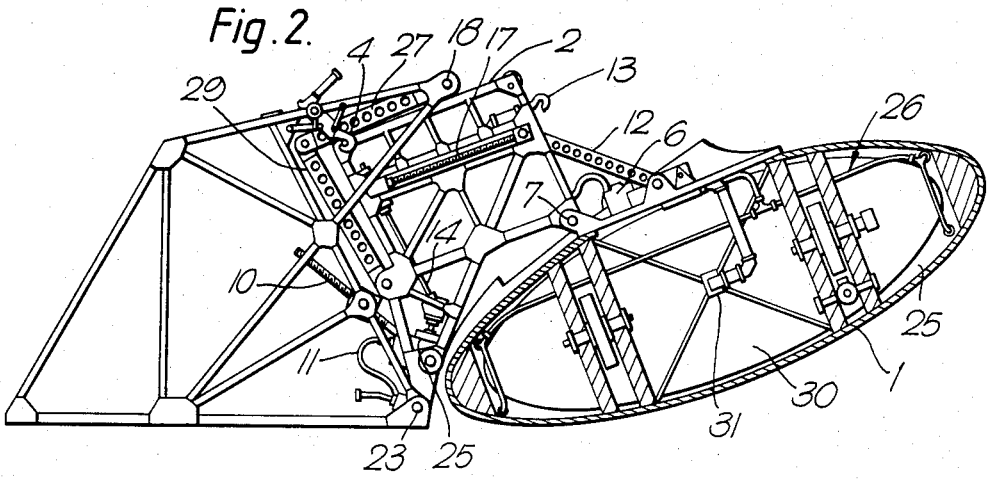

FIGS. 1 and 2 show the deployment mechanism for the pod. The rotodome pod 1 is shown in its deployed and retracted positions in FIG. 1, those parts of the pod which are referenced in their deployed position being indicated by dashed reference numerals in their corresponding retracted positions. Rotodome pod 1 is provided with inflatable bags (not shown in FIGS. 1 and 2) mounted on opposite flattened faces of the rotodome. These bags may be inflated when the pod is deployed (via pipes 26) to give rotodome 1 an aerodynamic shape which can be rotated about 360° by a drive mechanism 6. The diameter of the rotodome when deployed is considerably greater than its transverse dimension when retracted. The pod incorporates a Cassegrain aerial system comprising a flat plate reflector 30 and a central microwave feed horn 31. Feed horn 31 is connected to a microwave radar receiver 5 by rigid waveguide 8, flexible wave-guide portion 11 and further lengths of waveguide (not shown) in the pylon structure. Pod 1 is hinged to pylon 2 (which is in the form of an aerodynamically shaped longitudinal fin) about an axis 7 and pylon 2 is in turn hinged to a supporting framework in the aircraft fuselage about axis 23. Pod 1 can be rotated relative to pylon 2 about axis 7 by a secondary lead screw 17. Pylon 2 can be retracted into and deployed from the aircraft fuselage by rotation about axis 23 in response to drive exerted by a primary lead screw 10. A pivotally mounted torque motor 25 drives leadscrew 10 directly and simultaneously drives leadscrew 17 via an articulated coupling shaft 14, the drives being mechanically ganged to substantially maintain the pod in its aerodynamic orientation as it is deployed from or retracted into the fuselage, as indicated by dashed lines 16. Alternatively the drives may be ganged electrically. A manual drive (not shown in FIGS. 1 and 2) is coupled to the leadscrews and can be used to retract the pod in the event of failure of the torque motor 25.

An air inlet duct 15 is incorporated in the pylon 2 and feeds an air-liquid heat exchanger 24 and a turbine power unit 25. Since extra power is only needed when the rotodome is deployed this arrangement avoids unnecessary drag.

The downward pivotal travel of pylon 2 is limited by a toggle linkage comprising an upper strut 27 articulated to a lower strut 29. The toggle linkage is hinged to the pylon 2 at 31 at one end and the pallet support structure 18 at the other end. Prior to retraction of the pod, the toggle linkage is broken by a hydraulically-actuated toggle-breaking mechanism 20 (FIG. 1) and the linkage is then folded as shown at 27' and 29' as leadscrew 10 retracts the pylon 2. In its fully retracted position the pod 1 protrudes slightly from the fuselage as shown at 1'. The fuselage door 3 is hinged to the fuselage at 9 and is up when the rotodome 1 is retracted. The rear of the fuselage is strengthened by a bulkhead 19. The pod-pylon assembly may be locked in the retracted and deployed positions respectively by locking hooks 4 and 13 respectively. In the former position the rotodome 1 is supported by a secondary linkage 12 (FIG. 2). The entire radar scanner unit comprising pod 1, pylon 2, their associated drive mechanisms and radar equipment and bulkhead 19 can be loaded bodily into the aircraft fuselage via the cargo door 3. If necessary the unit can be in the form of a plurality of articulated modules which are provided with limited freedom of movement in order to avoid exerting undue pressure on the aircraft fuselage.

Figure 4:
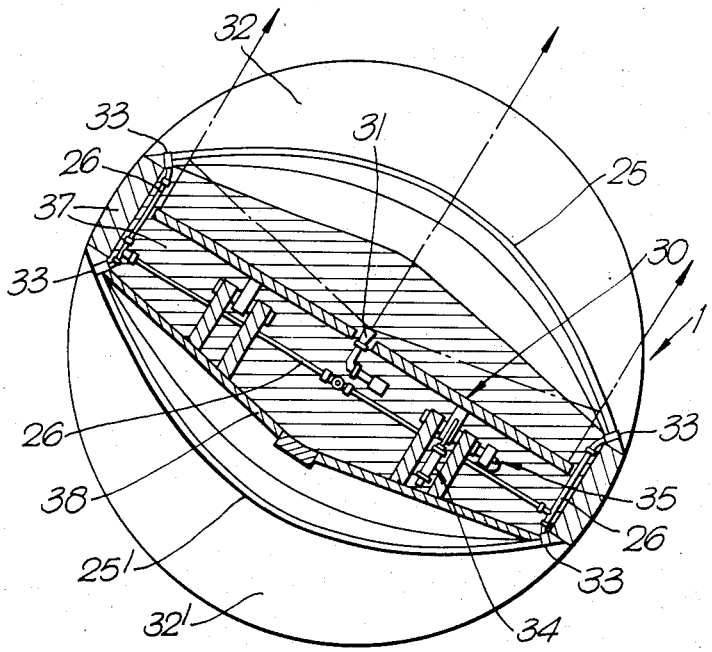
Figure 3:
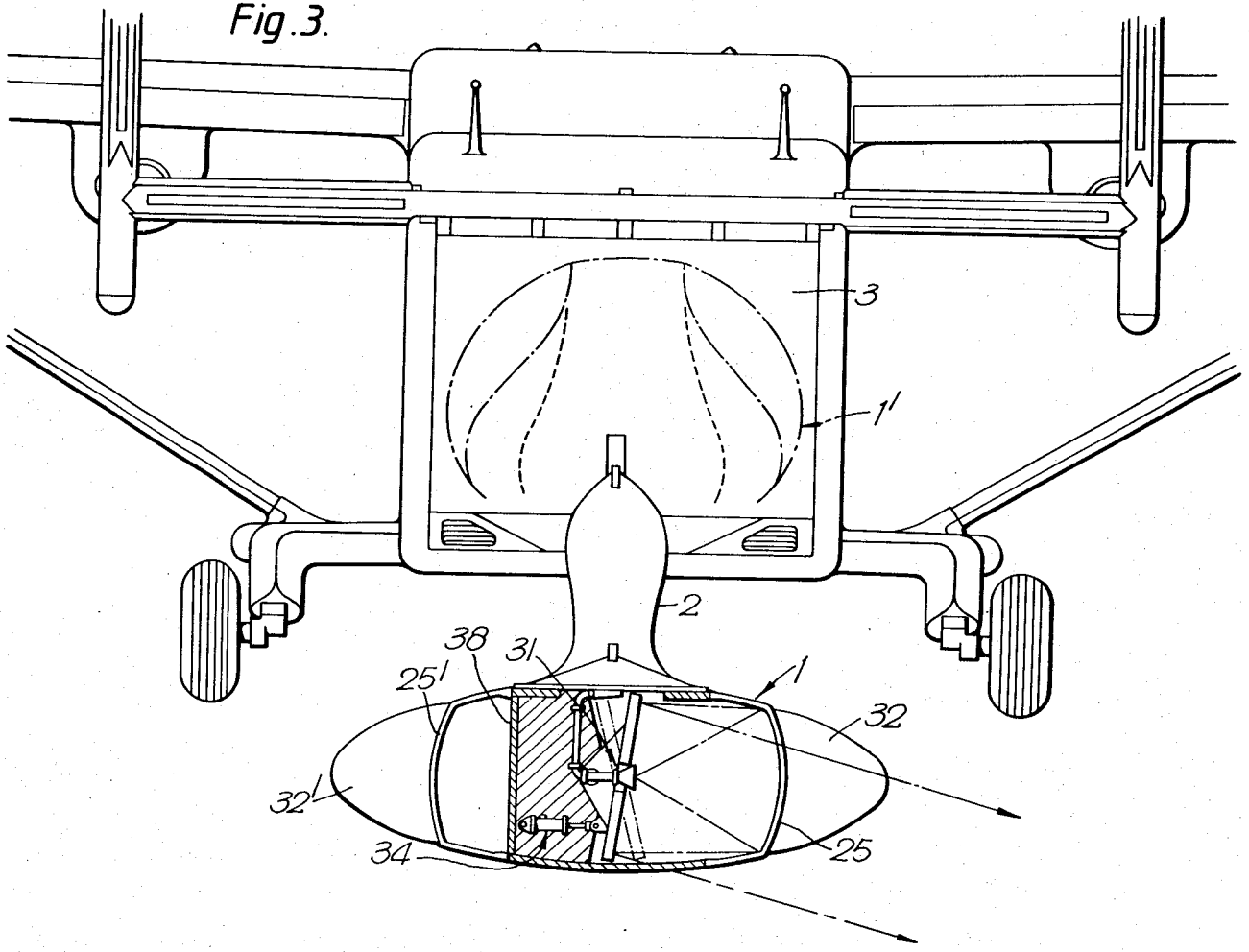

FIGS. 3 and 4 show the rotodome 1 in more detail. Cresent-shaped air-inflatable bag fairings 32,32' are mounted on opposite walls 25,25' of the aerial assembly, these walls being constructed of a rigid lightweight composite plastic material such as "NOMEX". Wall 25 incorporates a trans-reflecting sub-reflector which selectively transmits appropriately polarised radar signals from feed 31. A compressed air/suction feed is connected to air-pipes 26 via a suitable rotary joint (not shown) which in turn communicate with inflatable fairings 32 via ports 33. The assembly is strengthened by a structural stiff ring 37 and panels 38, all of "NOMEX".

The elevation of movable-plate reflector 30 may be varied by means of an elevation actuator 34 controlled with the aid of an elevation transducer 35 so as to vary the elevation of the radar beam by ±20°. The rotodome is retracted by opening door 3, deflating fairings 32,32' and retracting the pod-pylon assembly by means of motor 25 and screw linkages 10 and 17.

Figure 5:
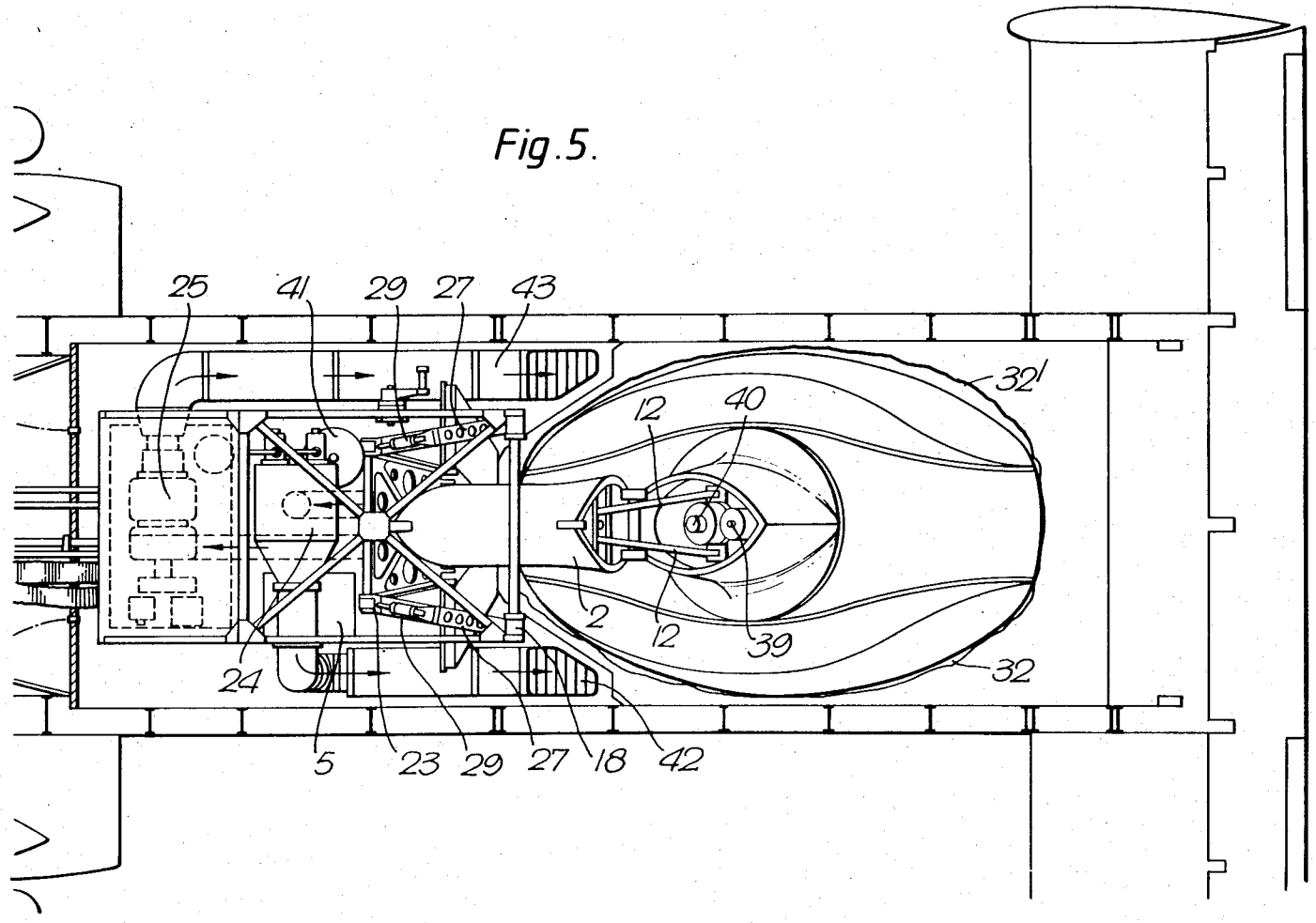
Figure 6A:
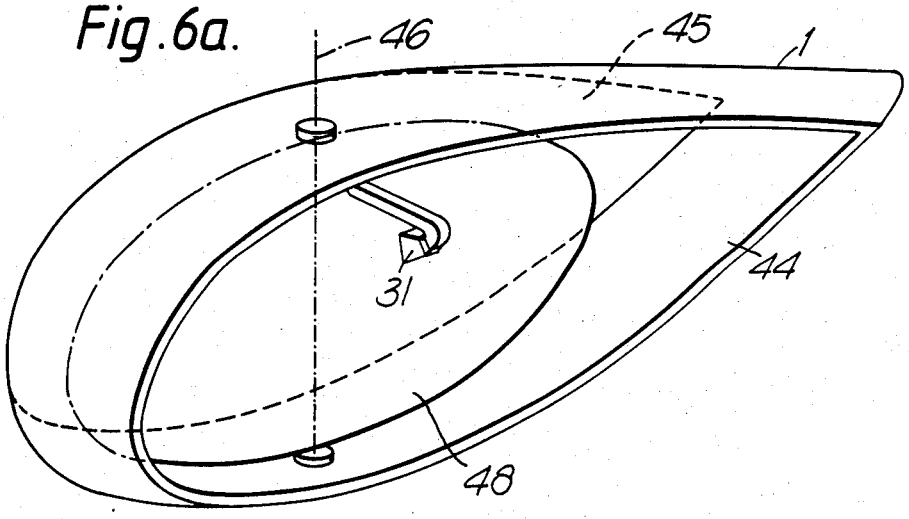
Figure 6B:
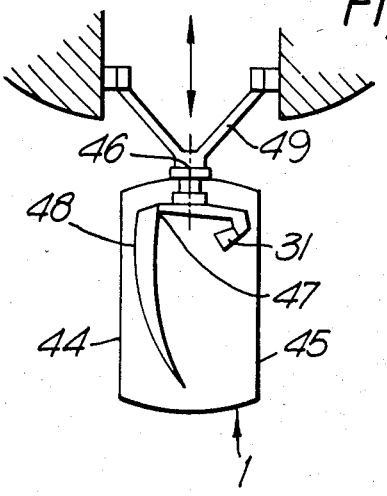
Figure 6C:
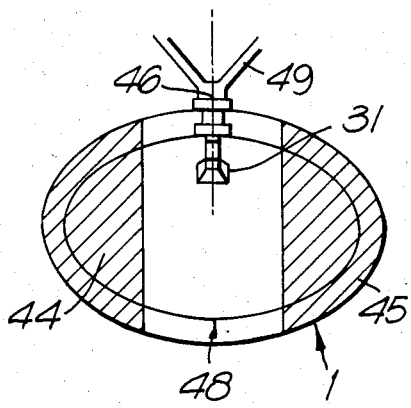
Figure 6D:
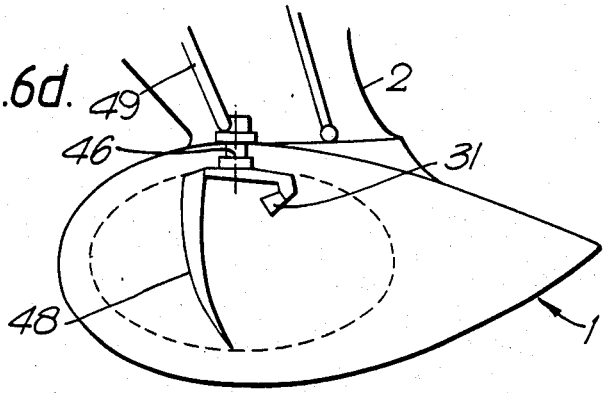

FIG. 5 shows the retracted rotodome in plan view with the fairings 32,32' deflated. A detachable air coupling 39 links pipe 26 (FIG. 4) to a compression/suction pump 41 via air pipes (not shown) in pylon 2 and a suitable flexible coupling (not shown) between the pylon and the fuselage. Similarly a detachable microwave coupling 40 links the aerial system to radar receiver 5. Exhaust air from heat exchanger 24 and power unit 25 is exhausted from the bottom of the fuselage via ducts 42 and 43 respectively.

FIG. 6 shows an alternative embodiment of the invention in which a radar dish 48 is mounted for rotation about a vertical axis 46 in a (non-rotating) radome 1. The sides of the radome 1 are cut away and covered with flexible plastic diaphragms 44,45. Radome 1 is mounted on a pylon 2 and deployed by means of a linkage 49 in a similar manner to that shown in FIGS. 1, 2, 4 and 5. When deployed (FIG.(*6b*)) the radome is pressurised to inflate diaphragms 44,45 (FIG. 6(*c*)) so that radar aerial 48 may be rotated about axis 46 to sweep the volume indicated by dashed lines in FIG. 6(*d*).

I claim:

1. An airborne scanner arrangement comprising:

(a) an aircraft fuselage elongated along a longitudinal dimension and having a transverse dimension extending generally perpendicular to the longitudinal dimension, (b) an aerodynamic radar pod having at least one external inflatable portion, (c) a radar scanner mounted for rotation within said pod about an axis, (d) means for deploying said pod from and retracting said pod into said aircraft fuselage, (e) means for internally pressurizing said portion when the pod is deployed to inflate said portion and thereby define part of the aerodynamic shape of the pod, and (f) means for depressurizing said portion on retraction of said pod into the aircraft fuselage.

2. A radar scanner arrangement according to claim 1 wherein said inflatable portion is a flexible membrane stretched over an aperture in an exterior wall of said pod, which membrane, when inflated, bulges out to accommodate the volume swept out by rotation of the radar scanner.

3. A radar scanner arrangement according to claim 1 wherein said pod is a rotodome and said inflatable portion is a fairing supported on a flattened wall of the rotodome, which fairing, when inflated, gives the rotodome a substantially rotationally symmetrical shape.

4. A radar scanner arrangement according to claim 2 wherein the diameter of the volume swept out by rotation of said radar scanner in the deployed pod is greater than the largest interior transverse dimension of the fuselage and said radar scanner is accommodated longitudinally within said fuselage when said pod is retracted.

5. A radar scanner arrangement according to claim 3 wherein the largest diameter of said rotodome, when said inflatable portion is inflated, is greater than the largest interior transverse dimension of said fuselage.

6. A radar scanner arrangement according to claim 2 comprising two said membranes diametrically disposed transverse to the fuselage about the axis of rotation of said radar scanner, said pod being elongate in the longitudinal dimension.

7. A radar scanner arrangement according to claim 3 comprising two said fairings inflatable to crescent shapes and diametrically disposed about the axis of rotation of the scanner.

8. A radar scanner arrangement according to claim 1 mounted on a supporting unit, said scanner arrangement and said supporting unit being capable of being bodily loaded into said fuselage via a cargo-loading aperture thereof.

* * * * *